United States Patent [19]

Yamazaki et al.

[11] 4,271,740

[45] Jun. 9, 1981

[54] CUTTING APPARATUS FOR POTTING MATERIAL WITH HOLLOW FIBERS EMBEDDED THEREIN

[75] Inventors: Masahiro Yamazaki, Yokohama; Takayasu Akiyama, Numazu; Yoshihiro Makuta, Fujisawa; Tosikuni Maruoka, Yokohama, all of Japan

[73] Assignee: Nippon Zeon Co., Ltd., Tokyo, Japan

[21] Appl. No.: 31,133

[22] Filed: Apr. 18, 1979

[30] Foreign Application Priority Data

Apr. 26, 1978 [JP] Japan ..... 53/49608

[51] Int. Cl.[3] ..... B26D 4/72

[52] U.S. Cl. ..... 83/592; 83/36; 83/395; 83/356.3; 83/915.5

[58] Field of Search ..... 83/42, 355, 356.3, 591–596, 83/913, 915.5, 395, 35, 36

[56] References Cited

U.S. PATENT DOCUMENTS

| | | | |
|---|---|---|---|
| 762,579 | 6/1904 | Dufford | 83/591 X |
| 1,367,508 | 2/1921 | Smith et al. | 83/592 X |
| 1,466,105 | 8/1923 | Trubisky | 83/592 |
| 1,947,323 | 2/1934 | Winston | 83/355 X |
| 2,416,717 | 3/1947 | Shaw | 83/555 X |
| 2,461,621 | 2/1949 | Allen | 83/915.5 X |
| 2,712,842 | 7/1955 | Fahrni | 83/591 |
| 3,426,633 | 2/1969 | Jores | 83/355 X |

*Primary Examiner*—J. M. Meister

*Attorney, Agent, or Firm*—McDougall, Hersh & Scott

[57] ABSTRACT

In a cutting apparatus wherein an object is cut in such a manner that a cutting blade is rotated relatively to the object, in which the cutting blade is constructed as a straight blade having a straight cutting edge which is defined by:

(a) a first blade surface to be positioned at an angle with a predetermined cutting plane of the object; and (b) a second blade surface to be positioned at a larger angle with the cutting plane of the object than that of the first blade surface, wherein on the relative rotation of the straight blade the first blade surface is so disposed as to be withdrawn from the cutting plane of the object toward the second blade surface without substantially contacting with the cutting plane.

16 Claims, 11 Drawing Figures

CUTTING APPARATUS FOR POTTING MATERIAL WITH HOLLOW FIBERS EMBEDDED THEREIN

BACKGROUND OF THE DISCLOSURE

Field of the Invention

The present invention relates generally to a cutting apparatus, and more particularly to a cutting apparatus for hollow fibers embedded in and extending through a potting material fluid tightly in a manufacturing process of a hollow-fiber permeability apparatus such as a hemodialyzer for an artificial kidney.

To selectively separate materials through a membrane on the basis of their different permeabilities, there have been proposed an effective method in which polymeric hollow-fiber membranes showing a selective permeability are used. This method is useful, for example, as a hemodialyzer which serves to help a patient suffering from renal failure out of his death, because the use of the hollow fibers brings in a large effective surface area for the small size of the apparatus. In such apparatus, numerous hollow fibers made of cellulose membrane or acrylonitrile copolymer are closely bundled and disposed into a housing having a cylindrical or a rectangular cross section. Both end portions of the hollow-fiber bundle are respectively fixed to both end portions of the housing in fluid-tight relationship with a solidifiable liquid (potting material) having a suitable elasticity in a solidified state. The potting material consists of a polymer composition of epoxy resin, polyurethane, silicone resin and so on. The hollow fibers are disposed substantially parallel with each other and longitudinally along the length of the housing with their end portions extending through the solidified potting material. After the solidifiable liquid is solidified or heat-treated, each hollow fiber embedded in the potting material is cut perpendicularly to the longitudinal direction of the fiber so that the end of the fiber may be opened in a cut-surface thereof. In an operation of manufactured hemodialyzer, the blood of the patient is passed through the interiors or hollow portions of the hollow fibers from the openings at the cut-surface, while a dialysate is passed along the exteriors of the hollow fibers, whereby various metabolic wastes in the blood are dialyzed through the hollow-fiber membranes.

One of the most difficult problems in the assembling process of the above-described permeability apparatus is the cutting of the potting portion. The difficulty is particularly due to the nature of the potting material. The inventors have found that when the cutting is done in a conventional way using, for example, a ham cutter, the end portions of the hollow fiber are considerably rubbed with a cutting edge at the cut-surface and at the openings formed therein. The cutting also causes clogging of the openings of the hollow fibers, separation of the hollow fibers from the potting material at the boundary therebetween, or uneveness of the cut-surface. The reasons for these phenomena are considered as follows. The potting material or resulting scraps thereof are partially melted and softened due to heat evolution by the mechanical cutting so as to cover and clog at least a part of the openings of the hollow fibers during the rotation of the cutting blade. And, the separation of the hollow fibers from the potting material at the boundary there-between and the uneveness of the cut-surface are caused due to shearing stress developing by the friction between the surface of the blade and the cut-surface of the potting portion.

These defects result in several serious troubles when the selective permeability apparatus is applied to hemodialysis. The blood is essentially liable to clot when contacting with foreign substances and this blood clotting is accelerated under disturbance of the blood flow. In general, when the renal failure patient is subjected to a dialysis therapy, the blood clotting often appears. It has been observed that the clotting develops and grows from uneven portions at the cut-surface of the hollow fibers, even if heparin is used as an anti-clotting agent. Such uneven portions involve, as described above, that the cut-surface is not smooth, the hollow fibers are slightly separated from the potting material by cutting, the cutting position of the hollow fiber (cut-surface of the hollow fibers) is dislocated from the surface of the potting material. The grown clotts of the blood cover the openings of the hollow fibers, and a part of the clotts separated intrudes into the hollow portions of the hollow fibers. In this case, the blood can not flow through the hollow portions to reduce dialysis efficiency and finally, the dialysis operation becomes impossible.

Since having intrinsic tackiness and elasticity as seen in rubber, the potting material such as polyurethane, silicone rubber or epoxy resin clings or sticks to the cutting blade on the cutting operation, and smooth cutting can not be effected. This is a phenomenon which appears also in cutting a block of, for example, polyurethane, and further which causes a trouble in cutting the polyurethane together with the hollow-fiber bundle of cellulose embedded therein and extending through as in the hemodialyzer.

Since the cellulose hollow fiber has a considerably high rigidity whereas the polyurethane has tackiness and elasticity, these materials have quite a different behavior against the cutting blade. This will be now explained with reference to FIG. 1 to FIG. 3. As shown in FIG. 1, when hollow fibers 2 buried in a potting material 1 are cut with a cutting blade 3 in the perpendicular direction to the longitudinal direction of the fiber, a part of the elastic potting material 1 is first cut and the hollow fiber 2 then starts being cut. However, as shown in FIG. 2, the hollow fiber 2 is liable to bend at the contacting portion with the cutting blade 3, without being cut. This is due to the larger rigidity of the hollow fiber 2 than that of the potting material 1 having elasticity. For this reason, the hollow fiber 2 is partially separated from the potting material 1 at the cut-surface thereof so that a cleft 4 is formed between the hollow fiber 2 and the potting material 1. The cleft is not formed at the opposite side of the hollow fiber 2 because the hollow fiber 2 is pressed to the potting material 1. However, as the hollow fiber 2 is cut in the bent state as aforesaid, the cut-surface obtained is not satisfactory smooth as shown in FIG. 3 wherein the cleft 4 remains and a slant cut-surface of the hollow fiber 2 extends therefrom. Accordingly, a cut-surface 5 is not flat at the opening of the hollow fiber 2 and the end of the hollow fiber 2 is projected from other flat parts of the cut-surface 5.

The blood clotting can not be avoided in the conventional hemodialyzer with the potted portion having the cross-section pattern shown in FIG. 3. In addition, the cutting operation shown in FIGS. 1 and 2 has some defects that the operation is not suitable for mass treatments and that the wear of the cutting blade is unavoidably increased.

SUMMARY OF THE INVENTION

An object of the present invention is to provide a cutting apparatus which can be easily and quickly operated with high accuracy and good economy particularly when hollow fibers embeded in and extending through a potting material are cut.

Another object of the present invention is to provide a cutting apparatus wherein the hollow fibers are round-opened at a cut-surface so that a fluid can smoothly flow along the interiors of the hollow fiber, without developing any defects which involve the damage to the cut-surface, a partial or complete clogging of the openings of the hollow fibers formed by the cutting, separation of the hollow fibers from the potting material, and uneveness of the cut-surface.

A further object of the present invention is to provide a cutting apparatus which brings in an extremely smooth or flat cut-surface when the hollow fibers buried in the potting portion are cut together with the potting material in the perpendicular direction to the length direction, particularly in order to prevent a blood clotting in a hemodialyzer for an artificial kidney.

A still further object of the present invention is to provide a cutting apparatus which is suitable for mass treatments and includes a cutting blade requiring only lesser times of sharpening.

According to an aspect of the present invention, in a cutting apparatus wherein an object is cut in such a manner that a cutting blade is moved rotatory relatively to the object, in which the cutting blade is constructed as a straight blade having a straight cutting edge which is defined by:

(a) a first blade surface to be positioned at an angle with a predetermined cutting plane of the object; and (b) a second blade surface to be positioned at a larger angle with the cutting plane of the object than that of the first blade surface, wherein on the relative rotation of the straight blade the first blade surface is so disposed as to be withdrawn from the cutting plane of the object toward the second blade surface without substantially contacting with the cutting plane.

The other objects, features and advantages of the present invention will be apparent from the following description taken in conjunction with the accompanying drawings.

DESCRIPTION OF THE PREFERRED EMBODIMENTS

According to a preferred construction of the present invention, hollow fibers buried in a potting portion is pre-cut together with the potting material at a predetermined position and is then finally cut at a final set-position or a predetermined cutting plane to open the hollow fibers thereat. In this final cutting, the object, or the hollow fibers buried in the potting material is guided by a guide member for controlling the height of the object from a cutting edge of a straight blade which is fixed on a rotary chassis. Under this condition the object is finally cut with the rotating straight blade as the chassis rotates.

Figure 4:
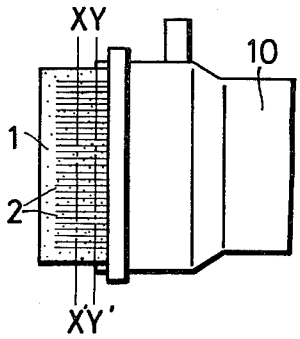
FIG. 4 is a partial front view of an end portion of a hemodialyzer before being cut, according to the first embodiment of the present invention.
Figure 5:
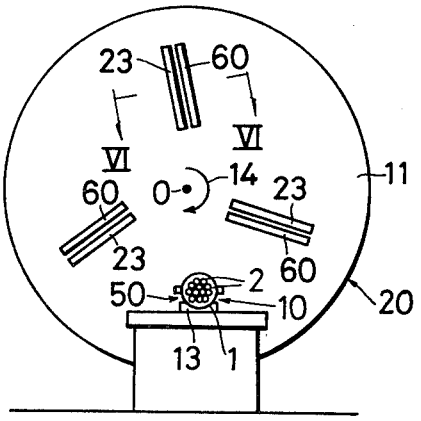
FIG. 5 is a plane view of a cutting apparatus according to the first embodiment of the present invention.
Figure 6:
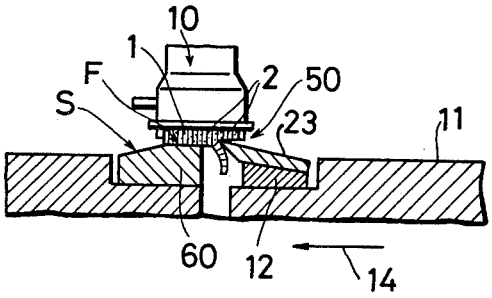
FIG. 6 is an enlarged cross-sectional view taken along the line VI—VI of FIG. 5 at the time when hollow fibers are cut with a straight cutting blade.
Figure 7:
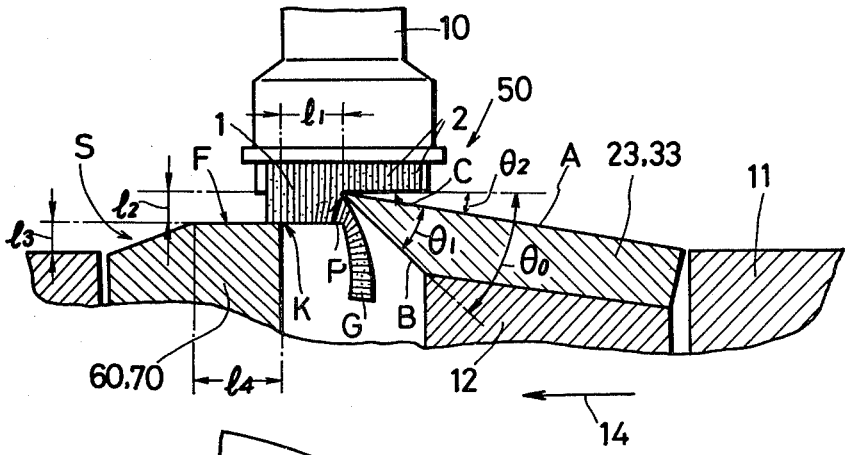
FIG. 7 is an enlarged view of FIG. 6 showing a state that the cutting of the hollow fibers is advancing.
Figure 8:
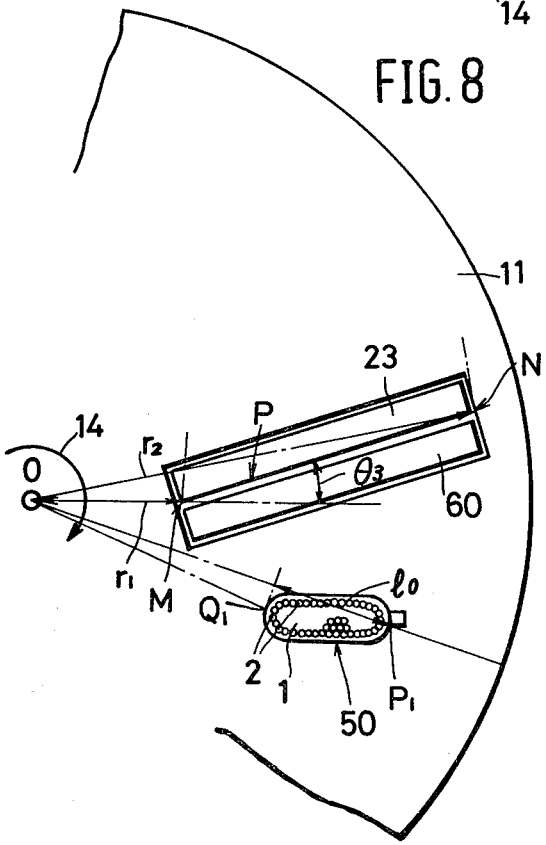
FIG. 8 is an enlarged partial plane view of the cutting apparatus for cutting an object contained in a flattened housing.

In more details, the object is precut at a predetermined position X—X' as shown in FIG. 4 with a cutting apparatus 20 mentioned below or a conventional cutter. The conventional cutter may be a kitchen knife; a cutter using a saw blade such as a fret saw, a band saw or a circular saw; a cutter such as a ham cutter using a circular blade; a cutter using a band blade; a paper cutter or a guillotine cutter using a straight blade; or a rotary cutter using a grind stone blade. After the precutting, the object is finally cut with a cutting apparatus described below at a position Y—Y' in FIG. 4. In this final cutting, as shown in FIG. 5, a housing 10 containing hollow fibers 2 fixed thereto with a potting material 1 is attached to a support 13 of the cutting apparatus 20. Three guide members 60 for the object are respectively mounted on a rotary chassis 11 at an angle of 120° relative to each other around the rotation center 0 as shown in FIG. 5. An upper flat surface F of the guide member 60 in FIGS. 6 and 7 is positioned at a distance $l_3$ above the upper surface of the chassis 11 which is rotatable in the direction shown by an arrow 14. Each of three straight blades 23, as shown in FIG. 7 is mounted on the rotary chassis 11 through a supporting bed 12, corresponding to each guide member 60. In this case, the straight blade 23 is so disposed that a blade back surface A is positioned at an angle $\theta_2$ with a cut-surface C of the object not so as to contact with the cut-surface (C). A cutting edge line P of the straight blade 23 is positioned at an angle $\theta_3$ with the radial direction of the rotary chassis 11 as shown in FIG. 8, and that the cutting edge line P is at a distance $l_2$ above the flat surface F of the guide member 60. Under this condition, the support 13 is forwarded in a certain feeding pitch in FIG. 6 to bring the object 50 into contact with the flat surface F of the guide member 60. After the object 50 is thus supported on the flat surface F of the guide member 60, the chassis 11 is rotated at a given rotation time to cut the hollow fibers 2 together with the potting material 1, so that the hollow fibers 2 are opened at the cut-surface thereof. If necessary, the hollow fibers 2 may be cut repeatedly every suitable slice as the object is forwarded stepwise. The cutting apparatus 20 can be used for cutting an object 50 having a circular cross-section shown in FIG. 5 or a flat cross-section shown in FIG. 8.

In the straight blade 23, shown in FIG. 7 a nose angle $\theta_1$ thereof is practically 15° to 29° and preferably 18° to 25°. When the angle $\theta_1$ is less than 15°, the blade is easy to be worn and damaged. And, when the angle $\theta_1$ is in excess of 29°, the hollow fibers are opened at the cut-surface in an inferior state. In the case that the angle $\theta_1$ is too large, the cutting of the hollow fibers is impossible. The angle $\theta_2$ formed by the blade back surface A with the cut-surface C is preferably 1° to 5° and more preferably 2° to 4°. When the angle $\theta_2$ is less than 1°, the surface A is apt to contact with the surface C so that the surface C is deteriorated. And, when the angle $\theta_2$ is more than 5°, an apparent nose angle or an angle $\theta_0$ of a blade front surface B with the cut-surface C is blunt and the cut-surface is unsatisfactory and often deteriorated. The cut-surface C lies in a predetermined cutting plane of the object 50. The angle $\theta_0$, which is the sum of the angle $\theta_1$ and the angle $\theta_2$, is preferably 16° to 30° and more preferably 18° to 30° and more preferably 18° to 28°. The angle $\theta_0$ means a sharpness of the blade on the cutting operation and also determines a quality in the state of the cutting surface. When the angle $\theta_0$ is less than 16°, the blade is easy to be worn and when the angle $\theta_0$ is more than 30°, the cutting itself becomes inferior.

In FIG. 8, the angle $\theta_3$ made by the blade edge line P with a straight line linking the rotation center 0 of the rotary chassis 11 to an edge point M of the blade 23 is in general 0° to 120°, preferably 30° to 110°, more preferably 60° to 100° and most preferably 90°. The angle $\theta_3$ is formed by the blade edge line P with a straight line linking the rotation center 0 to the object 50 when the blade 23 contacts with the object 50. Because the edge line P is positioned at the angle $\theta_3$, there is provided a cutting mechanism in which the object 50 is cut as the blade edge slides slantly against the object 50. For this reason, the apparent nose angle $\theta_1$ can be sharper than that shown in FIG. 7. When the angle $\theta_3$ is in excess of 120°, an effective part of the blade edge serving to cut the object 50 is too reduced to effect the cutting operation, and in an extrem case, the cutting operation becomes impossible.

Referring to FIG. 8, a distance between the rotation center 0 and an edge point N of the blade 23 positioned near to the peripheral margin of the rotary chassis 11 is represented by $r_2$, and a distance between the rotation center 0 and the edge point M near thereto is represented by $r_1$. Further, a difference of distance between the rotation center 0 and points $P_1$ and $Q_1$ of the object 50 is $l_0$, where the point $P_1$ is farthest from the rotation center 0 and the point $Q_1$ is nearest to the rotation center 0. This difference is equal to a substantial cutting length for the object 50. It is preferable that the difference of the distances $r_2$ and $r_1$, or $(r_2-r_1)$ is equal to or larger than the cutting length $l_0$. The difference $(r_2-r_1)$ is more preferably $l_0$ to $5l_0$, and further preferably $2l_0$ to $5l_0$.

The height $l_3$ of the flat surface F of the guide member 60 above the upper surface of the rotary chassis 11 is necessary in order that the cut-surface C formed by cutting the object 50 is prevented from contacting with the rotary chassis 11. From this viewpoint, the height $l_3$ is preferably in excess of 5/100 mm, and more preferably in excess of 8/100 mm. The height $l_2$ of the edge line P above the flat surface F of the guide member 60 is practically 2/100 to 2 mm, preferably 3/100 to 50/100 mm, and more preferably 3/100 to 15/100 mm. The feeding pitch of the support 13 described above is practically 2/100 to 2 mm, preferably 3/100 to 50/100 mm, and more preferably 3/100 to 15/100 mm. When the feeding pitch is less than 2/100 mm or more than 2 mm, the cutting of the object 50 is difficult so that the hollow fibers are liable to be deformed or clogged at the cut-surface C as well as the cut-surface C can not be obtained as a smooth surface. Particularly when the feeding pitch is more than 2 mm, the object 50 runs against the straight blade 23 with a strong impact and the blade 23 is easy to be broken or destroyed. It is important to so design that the feeding pitch is greater than the height $l_2$ and the object 50 does not contact with the rotary chassis 11 but contacts with the flatt surface F of the guide member 60. According to this designation, the object 50 is cut with the straight blade 23 as being supported and guided by the flat surface F of the guide member 60, so that a cutting length or the height $l_2$ of the object 50 can be precisely regulated to obtain a smooth cut-surface. In this case, it is necessary that the guide member 60 has a slope S extending from the same position as or the lower position than the rotary chassis 11 to the flat surface F, and that the flat surface F extends from the upper end of the slope S to the margin opposed to the blade edge, in order to effect a smooth contact of the object 50 with the guide member 60. A length $l_4$ of the flat surface F between the left end and the right end shown in FIG. 7 is not limited to a certain value, however, about 1 to 5 mm is sufficient for the length $l_4$.

The rotation speed of the rotary chassis 11 on the cutting operation is preferably up to 100 times per minute and more preferably 2 to 60 times per minute.

When the object 50 is subjected to the cutting operation, it is desirable that the support 13 is stepwise or intermittently forwarded or moved downward (FIG. 6) more than twice to the position where the object 50 is finally cut at the position Y—Y' shown by a dot-dash line in FIG. 4. The object 50 is repeatedly cut during that stepwise movement of the support 13.

In FIGS. 6 and 7, a distance between the edge line P of the straight blade 23 and an opposed edge line K of the flat surface F of the guide member 60 to the edge line P is represented by $l_1$. It is necessary that the distance $l_1$ is large enough to secure a necessary gap from which a swarf G of the object can escape into a space between the guide member 60 and the supporting bed 12. The cutting apparatus is so designated that the distance $l_1$ can be varied in a range of 0.5 to 4 mm in accordance with a cutting thickness or length of the object 50. However, when the distance $l_1$ is over 4 mm, it is hard to obtain a desirable smooth cut-surface of the object 50.

The above-mentioned potting material 1 used for the present invention may consist of polyurethane, silicone rubber, epoxy resin or the like, or these mixture. These materials have some elasticity and tackiness and is likely to be deformed under a stress imposed thereupon. The hollow fiber 2 may consist of synthetic, natural or semi-synthetic high polymers or the like. The hollow fiber 2 is necessary to have a selective permeability for materials to be separated, and to have an outer diameter preferably in a range of 10 to 500μ and a membrane thickness preferably in a range of 1 to 100μ. In most cases, such hollow fiber is not so tacky and elastic but rather has a rigidity to a certain degree, different from the potting material 1. Therefore, the hollow fiber has a poor deformability against a stress. The hollow fiber can be variously selected according to an object of application or to a kind of substances to be selectively separated from a mixture containing the same.

Figure 1:
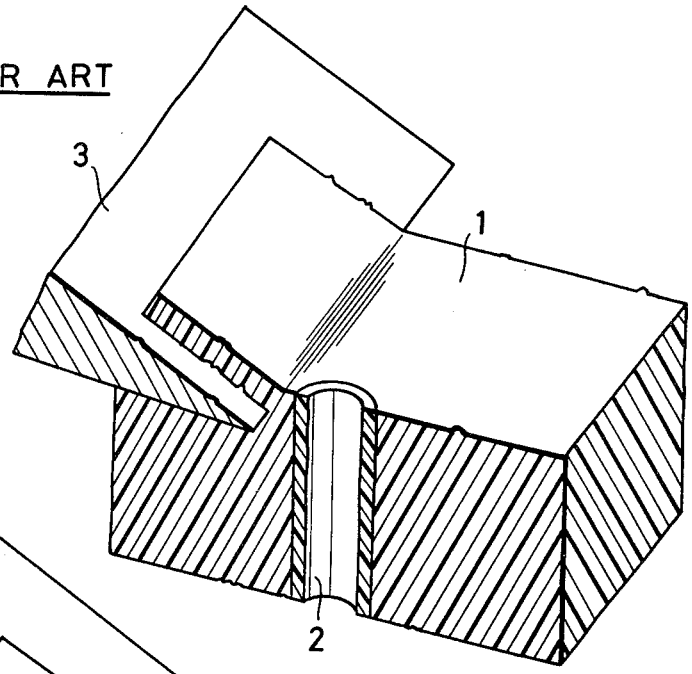
FIG. 1 PRIOR ART
FIG. 1 is a perspective view of a cross-section of the hollow fibers and the potting material when cut together in a conventional way.
Figure 2:
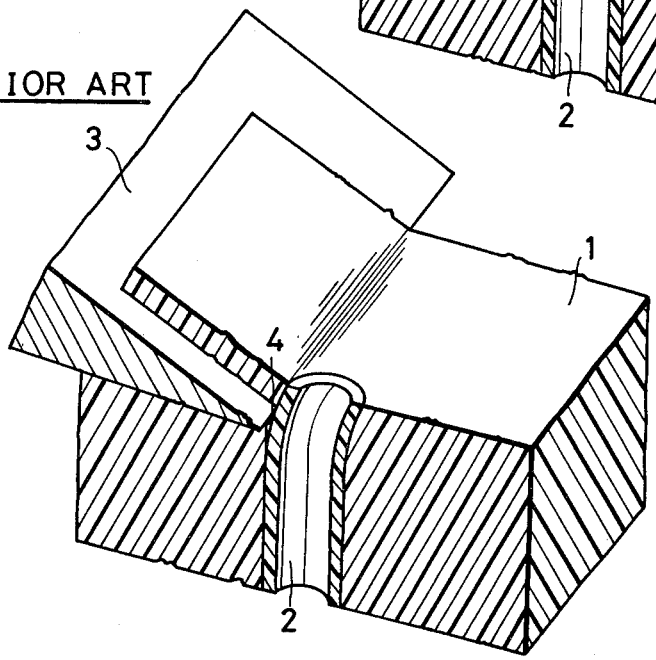
FIG. 2 PRIOR ART
FIG. 2 is a perspective view showing a state that the cutting blade contacts with the hollow fibers, similar to FIG. 1.
Figure 3:
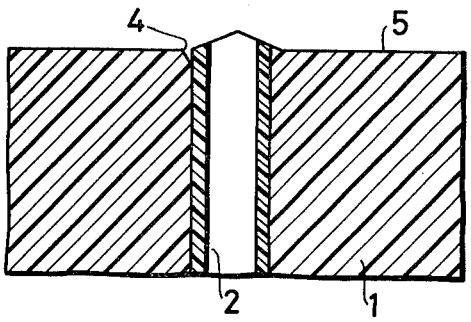
FIG. 3 PRIOR ART
FIG. 3 is a cross-sectional view showing the cut-surface obtained by the cutting operation shown in FIG. 2.

As understood from the above descriptions, the present invention has the following superior features:

First, because the blade back surface A of the straight blade 23 is positioned at the angle $\theta_2$ with the cut-surface C, the blade surface A is prevented from contacting with the cut-surface C in the cutting operation for the object 50. A remarkably smooth cut-surface can be formed if the object 50 is cut as being supported on the flat surface F of the guide means 60. By the above-mentioned designation of the nose angle $\theta_1$ of the blade 23, the angle $\theta_2$ of the blade back surface A with the cut-surface C, the angle $\theta_0$ formed by adding the angle $\theta_1$ to the angle $\theta_2$, and the angle $\theta_3$ of the edge line P of the blade 23, a satisfactory smooth cut-surface C can be obtained without the deformation and damage of the hollow fiber 2 thereat and without the cleft 4 between the hollow fiber 2 and the potting material 1 (See FIG. 3).

According to another feature of the present invention, if the angle $\theta_3$ made by the edge line P of the blade 23 with the radial direction of the rotary chassis 11, and the rotation number thereof are limited to the respective ranges described above, there can be prevented an unworkable cutting operation and a break-down of the blade edge due to eating of the blade 23 into the potting material 1 upon the cutting, and the object 50 can be repeatedly cut in a short time. Thus, a good cut-surface of the object 50 can be formed.

According to a further feature of the present invention, the angle $\theta_3$ results in a long life of the cutting edge of the straight blade 23 so that this can be advantageously used for industry. Even if the angle $\theta_0$ by the addition of the angle $\theta_1$ to the angle $\theta_2$ is relatively large, a smooth cut-surface and a true-circular opening of the hollow fiber 2 formed thereat can be well obtained.

In order to obtain a good cut-surface by the use of the cutting apparatus of the present invention, a durometer D hardness of the potting material is preferably 20 to 60. When the D hardness is lower than that range, a smooth cut-surface is hardly formed. And, when the D hardness is higher than that range, the wear of the blade is more increased and a longer time is required for the cutting operation.

Thus, the present invention can overcome the disadvantages seen in the conventional apparatus. According to the present invention, even if the potting material and the hollow fiber are different in rigidity, these are smoothly cut so as to form respective cut-surfaces lying in the same plane, under the abovedescribed cutting conditions. As the result, there is no fear that the cleft 4 shown in FIG. 3 remains at the boundary between the hollow fiber and the potting material and the opening of the hollow fiber at the cut-surface is deformed. The present invention can accordingly provide a remarkably smooth cut-surface without the end of the hollow fiber being projected therefrom, but with an opening of the hollow fiber having an approximately true-circular cross section. The cutting according to the present invention can be thus ideally effected. Such ideal cutting is seen also in the case that hollow fibers having a lower rigidity than a potting material, for example, hollow fibers of silicone type buried in epoxy resin are cut with the apparatus of the present invention.

The cutting apparatus of the present invention using the above rotary straight blade shows superior functions and technical effects that can not be found in a conventional cutting apparatus using a blade such as a rotary circular blade having a ring-shaped cutting edge. When the potting material and the hollow fibers are cut with the conventional apparatus using the rotary circular blade, burrs of the potting material remains in the hollow portions of the hollow fibers facing the cut-surface, and recesses and concaves of about 50 to 100$\mu$ in depth or height (circular grooves like the surface of a record) are formed at the cut-surface. On the other hand, in the apparatus of the present invention with the rotary straight blade, the above burrs are seldom observed and recesses and concaves at the cut-surface are, if any, about 5 to 10$\mu$ in depth or height. In general, the blood clotting is caused by the roughness of the cut-surface. However, the rotary straight blade of the present invention can provide the smooth cut-surface which brings about almost no blood clotting thereat in comparison with the conventional rotary circular blade. In addition, the straight blade of the present invention is easy to be exchanged for new one and also easy to be sharpened than the conventional blade such as the circular blade. By using of the straight blade, the cutting operation can be effected with a high accuracy and also high speed. Therefore the straight blade is more effective in practice and more suitable for mass production than the circular blade and so on. In the case of the conventional circular blade sharpening of the blade results in a smaller diameter of the blade, which brings about a troublesome operation for setting the sharpened blade at a further cutting position. On the contrary, the straight blade of the present invention can be easily set at a given cutting position only by moving thereto from the former position in the perpendicular direction to the major axis, though it becomes smaller in width after the sharpening.

The hemodialyzer containing the hollow fibers which have been cut with the apparatus of the present invention shows no blood clotting and no clogging of the blood in the hollow portions of the hollow fibers. This is very significant from a viewpoint that the most serious defect of the conventional hemodialyzer can be overcome.

Figure 9:
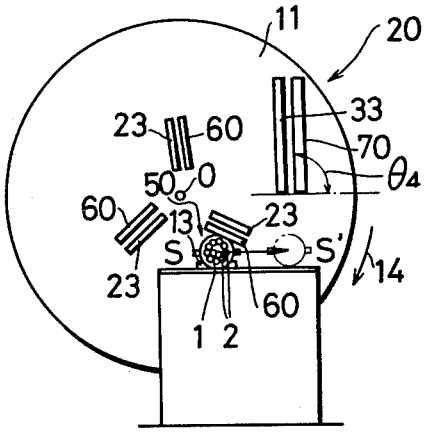
FIG. 9 is a plane view of a cutting apparatus according to another embodiment of the present invention.
Figure 10:
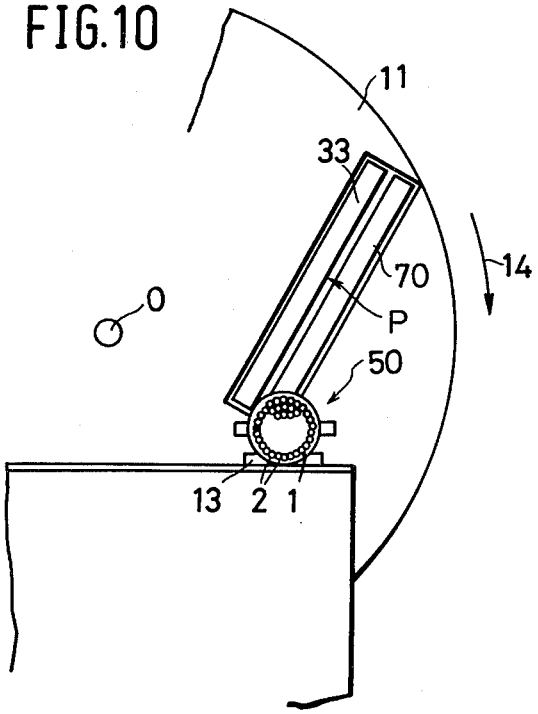
FIG. 10 is an enlarged partial view of FIG. 9 showing a state that an object contained in a cylindrical housing is cut.
Figure 11:
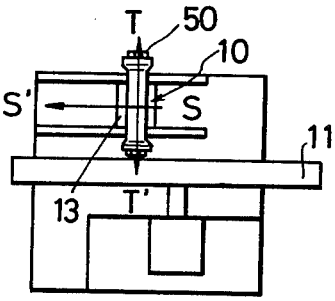
FIG. 11 is a side view of FIG. 9.

FIG. 9 to FIG. 11 show another cutting apparatus according to the present invention.

This cutting apparatus further includes a second rotary straight blade 33 having the same construction as the straight blade 23 shown in FIG. 5 to FIG. 8. When the cutting operation for the object 50 is effected, the first and second straight blades 23 and 33 are so disposed that their respective first blade surfaces are set with an angle to form a certain clearance, withdrawing from the cutting plane of the object 50 toward respective second blade surface, while only the edge is just placed or the cutting-line. It is important here that the cutting operation comprises a precutting and a final cutting. That is, the object 50 is first subjected to the precutting with the first straight blade 23 rotating relatively to the object at a high speed, and then it is further cut at a final position with the second straight blade 33 having a sharper cutting edge and rotating relatively to the object at a slower speed than the first straight blade 23.

In this embodiment, the object 50 is precut with the afore-said high speed straight blade 23 at the position X—X' shown in FIG. 4 to which it is repeatedly cut by plural times as being stepwise fed downward in FIG. 6. And, then the housing 10 is moved toward the low speed straight blade 33 where the precut object 50 is finally cut up to the final position Y—Y' shown in FIG. 4 repeatedly several times as being stepwise fed downward in FIG. 6. In order to effect this final cutting, the cutting apparatus 20 is so constructed that the housing 10 can be moved by a given distance between a precutting position S and a final cutting position S', and can be stepwise fed toward the straight blades 23 and 33 at the respective cutting position.

In the precutting operation, the housing 10 with the hollow fibers 2 fixed thereat is attached to the support 13 of the apparatus 20 shown in FIG. 9. The guide members or supporting members 60 are mounted on the rotary chassis 11 at an angle of 120° symmetrically around the center 0 of the rotary chassis 11 in the same arrangement in FIG. 7. The straight blade 23 has the nose angle $\theta_1$ being 30° to 40° in practice. When the angle $\theta_1$ is up to 30°, the cutting edge is easily worn and damaged due to the high speed rotation of the blade, and when the angle $\theta_1$ is in excess of 40°, there is a fear that the cutting can not be performed. The straight blade 23 has the angle $\theta_2$ of 2° to 5°, preferably 3° and the angle $\theta_0$ of 32° to 45°, preferably 35° to 38°. The angles $\theta_2$ and $\theta_0$ out of those ranges are not desirable by the same reasons as mentioned above. The straight blade 23 has further the same angle $\theta_3$ and the distance difference $(r_2-r_1)$ as defined in FIG. 8. However, it is preferable here that the chassis 11 is rotated at a higher speed than that mentioned in the afore-said embodiment, or at a rotation speed of 100 to 500 times per minute.

By the precutting of the hollow fibers 2 and the potting material 1 with the high speed straight cutter 23, the majority of the part to be cut off in the object can be removed therefrom. Besides, the high speed precutting can shorten the operation time required for the whole cutting operation including the precutting and the final cutting. The object can be precut to form a smooth and flat cut-surface because of the above dimension and shape of the blade 23, however, the openings exposed thereat of the hollow fibers 2 may not maintain a true-circular cross section at this precutting stage.

After the precutting is over, the housing 10 is moved from the precutting position S to the final cutting position S'. This movement can be easily performed with a high accuracy, as the support 13 is movable as shown in FIG. 11. The mechanism for the movement of the support 13 may be a known one and therefore the details will not be explained here.

A low speed straight blade 33 and a guide member 70 have substantially the same shapes as those of the high speed straight blade 23 and the guide member 60. Therefore, such shapes, particularly the shape and dimension of the cutting edge will not explained again. However, the straight blade 33 and the guide member 70 are longer than the straight blade 23 and the guide member 60. It is preferable that the straight blade 33 has the nose angle $\theta_1$ of 15° to 29° and is disposed at the angle $\theta_2$ of 1° to 5° with the object, from the same reasons as aforesaid. The rotation speed of the straight blade 33 on the final cutting is preferably less than that of the straight blade 23, for example, up to 100 times per minute.

A further important fact in this embodiment lies in the fact that an angle $\theta_4$ made by the straight blade 33 or the guide member 70 with the object 50 positioned at the position s' is approximately 90°. This angle $\theta_4$ is formed by the straight blade 33 or the guide member 70 with a straight line linking the rotation center 0 to the object 50, when the members 33 and 70 contact with the object 50 on the final cutting. If the angle $\theta_4$ is not kept at that value, the straight blade 33 is liable to contact with the object 50 with high impact which is not necessary, so that it is damaged or the final cutting itself is not smoothly effected.

The straight blade 33 is rotated at a slower speed and arranged at the angle $\theta_4$ of approximately 90°, so that the object 50 is slowly cut as an edge line P slides against the object 50 as shown in FIG. 10. Accordingly, the object 50 can be completely cut under the condition so that the total length of the edge line P of the straight blade 33 may contributes to the cutting during the rotation of the chassis 11. The blade 33 includes the sharply-shaped cutting edge which can serve for an ideal smooth cutting of the object.

As the result, the straight blade 33 can provide a smooth cut-surface similarly to the afore-said straight blade 23, as well as the true circular cross-section of the hollow fiber can be well maintained even after the cutting. The object 50 may be repeatedly cut by 2 to 5 times as being stepwise fed in a direction T—T' shown in FIG. 11 to a position where the final cutting is performed at the line Y—Y' shown in FIG. 4. This stepwise precutting results in a final cut-surface having a highly precise dimension because on each precutting the object 50 can be finely sliced.

As described above, this embodiment has a superior feature that the major part of the object 50 is first cut off with the high speed straight blade 23 and then the finishing cutting (final cutting) is slowly effected with the low speed straight blade 33. If the object 50 is cut solely with the straight blade 23 as in the first embodiment, the total cutting times is unavoidably increased. On the other hand, when the precutting with the blade 23 and the final cutting with the blade 33 are performed separately according to the present invention, the cutting times by the blade 33 for final cutting can be reduced. This means that the wear of the blade, in other words, the times for sharpening can be lesser. In addition, the present invention uses the blade 23 to cut off the major part of the object 50 at the high speed, whereby the operation time for each object is considerably shortened and the cutting times by the blade 33 is also decreased. For this reason, more increased number of the objects can be treated or mass treatment for the object can be achieved, which is very desirable from the industrial viewpoint.

In this embodiment, of course, the similar technical effects to those in the first embodiment can be obtained. For example, the arrangement of the straight blades 23 and 33 at the specific angle with the object 50 can prevent the contact of each blade surface with the cut-surface of the object 50 to obtain a smooth cut-surface.

The cutting apparatus of the present invention can be applied to the process of manufacturing of various kinds of selective permeability apparatuses as well as the hemodialyzer, for example, to an apparatus wherein materials are selectively permeated between gas and gas, or liquid and gas through the hollow fiber membranes. Although the straight blade 23 or 33 are rotated in the above embodiments, only the object to be cut may be rotated without the blades being rotated, or the blades and the object may be simultaneously rotated, for example, in a reverse rotation. The chassis 11 can be so moved relatively to the object 50 that the latter comes from the position S to the position S'. The angle $\theta_4$ made by the straight blade 33 is not limited to 90° and may be variously changed. The location of the straight blade 33 relative to the straight blade 23 can be modified.

Specific examples for the above embodiments will be now described, however, the present invention is not restricted to the examples and the embodiments and can be further modified on the basis of the technical concepts.

EXAMPLE 1

About eight thousand cellulose hollow fibers having an outer diameter of 300μ and an inner diameter of 200μ were bundled and then inserted into a given position in a cylindrical housing for hemodialyzer. Both end portions of the hollow-fiber bundle were fixed at the both ends of the housing by polyurethane consisting of a mixture of Sumijule PF by Sumitomo Bayer Corp. and castor oil (Sumijule PF: castor oil=1:2), in a conventional centrifugal potting method. As the result, the hollow fibers 2 were aligned in the lengthwise direction of the housing 10 and extended into the potting material 1 of polyurethane at the both ends as shown in FIG. 4. After being cured for 48 hours, D hardness of polyurethane was measured by a Durometer. At a moment of measurement D hardness shows 28, however, it is reduced to 24 after 10 seconds.

The potted portions were precut with a fret saw at the line X—X' shown in FIG. 4 and then finally cut with the rotary straight blade 23 at the line Y—Y', up to which the object was repeatedly cut as being fed in a certain feeding pitch. Here, the cutting conditions were as follows:

The total length of the blade 23: 32 cm.

The nose angle $\theta_1$: 22°.

The maximum blade thickness: 10 mm.

the angle $\theta_2$ made by the blade back surface A with the cut-surface C: 3°.

The angle $\theta_0$ made by the addition of the angle $\theta_1$ to the angle $\theta_2$: 25°.

The angle $\theta_3$ of the blade edge line P: 15°.

The distance $r_1$: 15 cm.

The height $l_3$ of the flat surface A of the guide member 60 above the rotary chassis 11: 8/100 mm.

The height $l_2$ of the blade edge line P above the flat surface F of the guide member 60: 7/100 mm.

The distance $l_1$ between the blade edge line P and the guide member 60: 1 mm.

The rotation speed of the rotary chassis 11: 20 rpm.

The feeding pitch or the cutting length of the object: 10/100 mm.

The total cutting length of the object: 10 cm

According to this example, the hollow fibers were very smoothly cut together with the polyurethane at a high speed and the cut-surface thereof was remarkably flat and smooth. As a result of observation with a magnifying glass, the cut-surface was superior in smoothness beyond comparison with the conventional one. The openings of the hollow fibers exposed at the cut-surface were approximately true-circular and uniform without any deformation seen in the conventional hollow fibers being cut with the known apparatus. It was found by the magnifying glass that there were observed no fine swarf and clogging of the opening of the hollow fiber which has been unavoidably seen in the case of using the conventional appratus. Further, there were no separation or cleft and no step (project part) between the hollow fiber and the polyurethane.

When a renal failure patient was subjected to a hemodialysis thereby under an artifical kidney assembled by the used of the cutting apparatus of this example, there was no trouble such as blood clotting which had been hitherto often observed.

EXAMPLE 2

About eight thousand cellulose hollow fibers having an outer diameter of 300μ and an inner diameter of 200μ were bundled and then inserted into a housing of a rectangular cross section. Both end portions of the hollow-fiber bundle were fixed to both end portions of the housing with polyurethane consisting of Vorite 689 (isocyanate) by N. L. Corp. and Policin 936 (polyol) by N. L Corp. (Vorite 689: Policin 936=48:52), in the conventional centrifugal potting method.

As shown in the following Table I, the curing time of the polyurethane was changed to control the hardness after curing. In the cutting operation for the potted portion, the angle $\theta_0$ of the blade 23 and the rotation number X of the chassis 11 were varied while the angle $\theta_2$ of the blade 23 was kept at 1°. Other cutting conditions were the same as the Example 1. The results obtained are as follows:

As clearly understood from the Table I, the hollow fiber and the potting material can be well cut under the condition that the D hardness after the curing of the potting material is 20 to 60, the angle $\theta_0$ is 16° to 30° and the rotation speed is less than 100 rpm. When the rotation speed and the hardness of polyurethane were over those ranges, the cutting blade was liable to be broken. Needless to say, this caused the somewhat bad state of the cut-surface.

TABLE I

| Sample No. | Curing Time of Polyurethane (hr) | Durometer D Hardness of Polyurethane*1 | Angle $\theta_0$ | Rotation speed for Cutting (rpm) | Cut State | |
|---|---|---|---|---|---|---|
| | | | | | Cut-surface | True Circle*2 |
| 1 | 2 | 10,8 | 25° | 40 | bad | bad |
| 2 | 16 | 26,20 | " | " | good | good |
| 3 | 24 | 53,40 | " | " | " | " |
| 4 | 48 | 60,48 | " | " | " | " |
| 5 | 720 | 90,36 | " | " | bad | " |
| 6 | 24 | 53,40 | " | 2 | good | " |
| 7 | " | " | " | 50 | " | " |
| 8 | " | " | " | 100 | " | " |
| 9 | " | " | " | 200 | bad | " |
| 10 | " | " | 11° | 50 | " | " |
| 11 | " | " | 16° | " | good | " |
| 12 | " | " | 21° | " | " | " |
| 13 | " | " | 30° | " | " | " |
| 14 | " | " | 35° | " | " | bad |

TABLE I-continued

| Sample No. | Curing Time of Polyurethane (hr) | Durometer D Hardness of Polyurethane*1 | Angle $\theta_0$ | Rotation speed for Cutting (rpm) | Cut State | |
|---|---|---|---|---|---|---|
| | | | | | Cut-surface | True Circle*2 |
| 15 | " | " | 60° | " | bad | Very bad |

*1The numeral on the left means a hardness obtained at a moment of measurement and the numeral on the right means a hardness obtained in 10 seconds thereafter.
*2This means a degree of true circular cross section of the opening of the hollow fiber at the cut-surface.

EXAMPLE 3

Similarly to the Example 2, cellulose hollow fibers are fixed to the both end portions of the housing of the rectangular cross section for blood dialysis. The potted portions were then cut under various conditions in which the height $l_2$ of the edge line P of the blade 23 was changed as shown in the following Table II. Other cutting conditions were kept constant as follows:

The feeding pitch of the support 13: larger than the height $l_2$ by 5/100 mm The height $l_3$ of the flat surface F of the guide member 60: 10/100 mm The distance $l_1$: twice as large as the feeding pitch of the support 13

The rotation speed of the chassis 11: 2rpm

The distance r1: 15 cm

The angle $\theta_3$: 90°

The length of the blade 23: 32 cm

The obtained results on the cutting state are shown in the Table II.

TABLE II

| Sample No. | Durometer D Hardness of Polyurethane*1 | Height l2 (mm) | Cut State | |
|---|---|---|---|---|
| | | | Cut-Surface | True Circle*2 |
| 16 | 53,40 | 1/100 | bad | good |
| 17 | " | 2/100 | good | " |
| 18 | " | 10/100 | " | " |
| 19 | " | 50/100 | " | " |
| 20 | " | 1 | " | " |
| 21 | " | 2 | " | " |
| 22 | " | 3 | bad | " |

*1 and *2 These mean the same as those shown in Table I.

Table II shows that a desirable cutting is effected when the height $l_2$ is selectively 2/100 to 2 mm. On the other hand, it is difficult to produce a uniform cut piece or to form a smooth cut-surface in the case that the height $l_2$ or the cutting length is less than 2/100 mm. Also in the case that the height $l_2$ is more than 2 mm, it is difficult to obtain a smooth cutfurface due to the fact that the blade eats strongly into the object.

EXAMPLE 4

Hollow fibers were fixed to both end portions of a housing similarly to the example 2. In this case, however, the cross section of the housing was circular and the radius of the potted portions was 3 cm.

The potted portions were then repeatedly cut under the various conditions in which the angle $\theta_3$ of the edge line P of the straight blade 23 was changed. The cutting was effected in such a manner that the location of the support 13 was moved so as to be capable of cutting the object 50 at each angle $\theta_3$. Other cutting conditions were as follows:

The height $l_3$ of the flat surface F of the guide member 60: 10/100 mm

The height $l_2$ of the edge line P of the straight blade: 9/100 mm

The feeding pitch of the support 13: 12/100 mm

The nose angle $\theta_1$: 22°

The angle $\theta_2$: 3°

The length of the straight blade 23: 32 cm

The rotation speed of the chassis 11: 40 rpm

The following Table III shows each result obtained in this example.

TABLE III

| Sample No. | Durometer D Hardness of Polyurethane*1 | Angle $\theta_3$ | Cut State | |
|---|---|---|---|---|
| | | | Cut-Surface | True Circle*2 |
| 23 | 53,40 | 0° | good | good |
| 24 | " | 45° | " | " |
| 25 | " | 90° | " | Very good |
| 26 | " | 120° | " | good |
| 27 | " | 130° | somewhat bad | " |

*1 and *2 These mean the same as those shown in Table I.

Table III apparently shows that a superior cut-surface can be obtained when the angle $\theta_3$ is in a range of 0° to 120°. In the case the angle $\theta_3$ is larger than necessary, the total length of the blade 23 can not be effectively used for the cutting. Particularly, the angle $\theta_3$ of considerably more than 90° is not desirable because the edge point M of the cutting edge nearer to the rotation center 0 is liable to directly contact with the object 50 to prevent the cutting operation itself when the straight blade 23 is driven with the rotation of the chassis 11. The angle $\theta_3$ of approximately 90° is most preferable from the viewpoint that the total length of the cutting edge can be effectively used for the cutting of the object 50 and a life of the blade can be improved.

EXAMPLE 5

About eight thousand semipermeable hollow fibers having an inner diameter of about 280μ and consisting of a copolymer of 97% acrylonitrile and 3% methallyl sulfonic acid were bundled and then inserted into a cylindrical housing to produce blood dialyzer. Both end portions of the hollow-fiber bundle were potted at the housing with Silastic by Dow Corning Corp.

The potted portions were then cut in the perpendicular direction to the length direction of the hollow fiber by a cutting apparatus similar to that in the Example 1.

The obtained cut-surface was remarkably uniform and flat and the cross section of the opened hollow fibers thereat was kept true circular.

When a blood dialysis was operated by the use of the hemodialyzer containing the hollow-fiber bundle which had been cut with the apparatus in this example, no blood clotting appeared.

EXAMPLE 6

About four thousand and eight hundred polymethyl methacrylate hollow fibers having an inner diameter of about 280μ and an outer diameter of about 350μ were bundled and inserted into a cylindrical housing for hemodialyzer. Both end portions of the hollow-fiber bundle were fixed to the housing with silicone rubber, for example, Toshiba Silicone TSERTV 3402 by Toshiba Silicone Corp.

The potted portions were cut in the perpendicular direction to the length direction of the hollow fiber by a similar cutting apparatus to that in the Example 1.

Also in this Example, an extremely smooth cut-surface was obtained and there were no distortion or deformation of the hollow fibers at these openings and no separation of the hollow fibers from the silicone rubber.

When a blood dialysis was operated by the use of the hemodialyzer containing the hollow-fiber bundle which had been cut according to this Example, no blood clotting occured. This was a proof showing a superior smoothress and uniformity of the cut-surface of the potted portions.

EXAMPLE 7

About twenty thousand cellulose acetate hollow fibers having an inner diameter of about 460μ and an outer diameter of about 530μ were bundled and contained in a cylindrical housing. Both end portions of the hollow-fiber bundle were then fixed to the housing with an epoxy resin by Cemedine Corp. in the conventional centrifugal potting method.

The potted portions were cut with a similar cutting apparatus to that in the Example 1.

The cutting operation was smoothly effected to obtain an extremely uniform and flat cut-surface. The hollow fibers were beautifully and uniformly opened thereat without deformation, clogging and separation from the potting material.

EXAMPLE 8

About three thousand gas-permeable hollow fibers of silicone rubber membrane having an inner diameter of about 0.3 mm were bundled and contained in a housing. Both end portions of the hollow-fiber bundle were potted at the housing with an epoxy resin.

The potted portions were cut similarly to the Example 1. As a result, a remarkably smooth cut-surface was obtained as well as an approximately true circular opening of the hollow fiber without distortion and deformation.

Oxygen-carbon dioxide exchange for the blood was performed by the use of a dialyzer as an artificial lung assembled in this Example. As a result, there was no blood clotting in the interiors of the hollow fibers.

EXAMPLE 9

The same operation as the Example 1 except that hollow fibers having an inner diameter of about 320μ were made of Nylon (Polyamide synthetic fiber) by E. I. Du Pont de Nemours & Co. in place of cellulose, was effected in this Example.

Also in this Example, a smooth cut-surface of the potted portion was obtained without concaves or convexes between the respective cut-surfaces of the hollow fiber and the potting material. The hollow fibers were opened thereat with a true circular cross section.

EXAMPLE 10

The same operation as the Example 3 except that about one thousand hollow fibers of polyepichlorohydrine having an inner diameter of about 360μ was effected in this Example.

The obtained cut-surface was very beautiful/and smooth without separation and crack at the boundary between the hollow fiber and the potting material.

EXAMPLE 11

Hollow fibers of polysulfone having an inner diameter of about 210μ were used in this Example. Other conditions were the same as the Example 6.

As a result, a remarkably beautiful cut surface of the potted portion was obtained.

What is claimed is:

1. An improved apparatus for cutting potting material with hollow fibers embedded therein, said apparatus including a cutting blade and a rotatable chassis for carrying said blade, said material being cut in such a manner that said cutting blade is rotated relative to said material, said cutting blade comprising a straight blade having a straight cutting edge, said improvement comprising:

(a) said cutting edge defined by a first blade surface to be positioned at an angle with a predetermined cutting plane of said material and a second blade surface to be positioned at a larger angle with said cutting plane of said material than that of said first blade surface; and (b) means carried by said rotatable chassis for supporting said material as the latter is being cut by said blade, said supporting means mounted to and extending outwardly from said chassis so that said material does not contact the chassis, wherein on the relative rotation of said straight blade said first blade surface is so disposed as to be withdrawn from said cutting plane of said material toward said second blade surface without substantially contacting with said cutting plane, thereby achieving an extremely smooth planar cut of the potting material and hollow fibers.

2. A cutting apparatus according to claim 1, wherein a nose angle of said straight cutting edge is 15° to 29°, said angle made by said first blade surface of said straight cutting edge with said cutting plane of said material is 1° to 5°, and said angle made by said second blade surface of said straight cutting edge with said cutting plane of said material is 16° to 30°.

3. A cutting apparatus according to claim 1, wherein an angle made by an edge line of said straight cutting edge with a straight line linking a rotation center on the cutting operation to said material is 0° to 120° when said straight blade contacts with said material upon the cutting operation.

4. A cutting apparatus according to claim 3, wherein a difference in distance between said rotation center and two edge points of said straight cutting edge beng farthest from and nearest to said rotation center is equal to or larger than a difference in distances between said rotation center and two points of said material being farthest from and nearest to said rotation center.

5. A cutting apparatus according to claim 1, wherein said straight blade comprises first and second straight blades being separately arranged from each other in which said object is precut with said first straight blade rotating relatively to said object at a high speed, and thereafter it is further cut with said second straight blade having a sharper cutting edge and rotating relatively to said object at a lower speed than said first straight blade.

6. A cutting apparatus according to claim 5, wherein said first straight blade is positioned nearer to said rotation center and said second straight blade is positioned farther from said rotation center, and there is provided means to move said object from the cutting position by said first straight blade to the cutting position by said second straight blade.

7. A cutting apparatus according to claim 5, wherein a nose angle of said straight cutting edge of said first straight blade is 30° to 40°, said angle made by said first blade surface of said first straight blade with said cutting plane of said object is 2° to 5°, and said angle made by said second blade surface of said first straight blade with said cutting plane of said object is 32° to 45°.

8. A cutting apparatus according to claim 5, wherein an angle made by an edge line of said straight cutting edge of said first straight blade with a straight line linking said rotation center on the cutting operation to said object is 0° to 120° when said first straight blade contacts with said object upon the cutting operation.

9. A cutting apparatus according to claim 8, wherein a difference in distances between said rotation center and two edge points of said straight cutting edge of said first straight blade being farthest from and nearest to said rotation center is equal to or larger than a difference in distances between said rotation center and two points of said object being farthest from and nearest to said rotation center.

10. A cutting apparatus according to claim 5, wherein a nose angle of said straight cutting edge of said second straight blade is 15° to 29°, said angle made by said first blade surface of said straight cutting edge of said second straight blade with said cutting plane of said object is 1° to 50°, and an angle made by an edge line of said straight cutting edge of said second straight blade with a straight line linking a rotation center on the cutting operation to said object is approximately 90° when said second straight blade contacts with said object upon the cutting operation.

11. A cutting apparatus according to claim 5, wherein a rotation speed of said first straight blade on the precutting is 100 to 500 times per minute and a rotation speed of said second straight blade on the further cutting is less than 100 times per minute.

12. A cutting apparatus according to claim 1, wherein said potting material has a durometer D hardness of 20 to 60 after curing, and said hollow fibers embedded therein having a higher rigidity than said potting material.

13. The apparatus according to claim 1 wherein the length of material to be cut off is determined by the distance between the cutting edge of the blade and said supporting means.

14. The apparatus according to claim 1 wherein an oblique angle is formed between said straight cutting edge and a straight line linking a rotation center of the chassis to a point on the perimeter of said chassis, whereby said blade moves obliquely with respect to said material.

15. The apparatus according to claim 14 wherein said angle exceeds 30 degrees.

16. The apparatus according to claim 1 wherein the rotation speed of the blade is less than 100 revolutions per minute.

* * * * *